US005705228A

United States Patent [19]

Kornmann

[11] Patent Number: 5,705,228

[45] Date of Patent: Jan. 6, 1998

[54] METHOD FOR THE CONTINUOUS COATING OF A FILIFORM STEEL SUBSTRATE BY IMMERSION OF THE SUBSTRATE IN A BATH OF MOLTEN COATING METAL

[75] Inventor: Michel Kornmann, Grand-Lancy, Switzerland

[73] Assignee: Battelle Memorial Institute, Switzerland

[21] Appl. No.: 684,987

[22] Filed: Jul. 22, 1996

Related U.S. Application Data

[63] Continuation of Ser. No. 819,670, Jan. 13, 1992, abandoned, which is a continuation of Ser. No. 571,845, Aug. 23, 1990, abandoned, which is a continuation of Ser. No. 306,675, Feb. 6, 1989, abandoned.

[30] Foreign Application Priority Data

Feb. 9, 1988 [CH] Switzerland ..... 453/88

[51] Int. Cl.[6] ..... B05D 1/18

[52] U.S. Cl. ..... 427/430.1; 427/431; 427/434.7

[58] Field of Search ..... 427/430.1, 431, 427/434.7

[56] References Cited

U.S. PATENT DOCUMENTS

| | | | |
|---|---|---|---|
| 3,779,056 | 12/1973 | Padjen | 427/431 |
| 4,026,731 | 5/1977 | Pemne | 148/153 |
| 4,144,379 | 3/1979 | Patil et al. . | |
| 4,169,426 | 10/1979 | Kornmann | 427/434.7 |
| 4,431,688 | 2/1984 | Kornmann | 427/434.7 |
| 4,529,628 | 7/1985 | Haour | 427/319 |
| 4,655,852 | 4/1987 | Rallis | 427/431 |
| 4,719,962 | 1/1988 | Haour | 427/319 |
| 4,830,683 | 5/1989 | Ferguson | 148/12 R |

FOREIGN PATENT DOCUMENTS

| | | | |
|---|---|---|---|
| 248243 | 10/1960 | Australia | 427/431 |
| 748837 | 12/1966 | Canada | 427/431 |
| 60225 | 9/1982 | European Pat. Off. . | |
| 0195473 | 9/1986 | European Pat. Off. . | |
| 57-82467 | 5/1982 | Japan . | |
| 170250 | 9/1984 | Japan | 427/431 |
| 59-170250 | 9/1984 | Japan . | |
| 46359 | 3/1985 | Japan | 427/431 |
| 60-16359 | 3/1985 | Japan . | |
| 60-121263 | 6/1985 | Japan . | |
| 1194392 | 6/1970 | United Kingdom | 427/431 |
| 88/04284 | 6/1988 | WIPO . | |

*Primary Examiner*—Benjamin Utech

*Attorney, Agent, or Firm*—Cushman Darby & Cushman IP Group of Pillsbury Madison & Sutro LLP

[57] ABSTRACT

A steel wire to be coated is brought across the graphite spout of a crucible filled with a bath of molten metal, after having first been heated in a tubular duct filled with protective gas by an electric coil powered by a high frequency source to a temperature lower than that of the molten metal contained in the spout. The melting point of this metal is greater than the austenizing temperature of the steel. On leaving the spout, the coated steel wire is then cooled in a controlled manner to avoid hardening, for example, if it is a question of a steel of approximately 0.7% carbon, by having it spend several seconds in a fluidized bed whose temperature is maintained at a temperature of the order of 550° C.

3 Claims, 2 Drawing Sheets

METHOD FOR THE CONTINUOUS COATING OF A FILIFORM STEEL SUBSTRATE BY IMMERSION OF THE SUBSTRATE IN A BATH OF MOLTEN COATING METAL

This is a continuation of application Ser. No. 07/819,670, filed on Jan. 13, 1992, which was abandoned upon the filing hereof.

BACKGROUND OF THE INVENTION

1. Field of the Invention

The present invention concerns a method for the continuous coating of a filiform (wire) steel substrate by immersion of the substrate in a bath of the coating metal in a molten state.

The continuous coating of a filiform or wire-form substrate by immersion implies the rapid passage of the substrate, the temperature of which is less than that of the molten coating metal, through the spout of a crucible filled with the metal in a molten state, which solidifies rapidly on contact with the relatively colder substrate.

2. Description of the Prior Art

Numerous solutions based on this principle have already been proposed, for example, in GB-982,051, or in FR 1,584,626. These methods generally have in common passing through the crucible spout containing the molten metal by a movement from bottom to top, the speed, the cross-section of the passage and the capillarity of the spout preventing escape of the molten metal.

This technique has already been used to form a coating on a wire whose cross-section is greater than that desired, the wire once coated being then re-drawn to bring it to the final cross-section. In the case of steel wires, it is necessary that the crystalline structure of the steel be sufficiently softened. This implies that the wire undergoes a prior heating to its austenizing temperature, followed by a controlled cooling which is dependent on the composition of the steel, with a view to conferring on it the crystalline structure required. Until now, this technique has been applied to coating metals whose melting point was lower than the austenizing temperature of the steel, so that the steel wire underwent, prior to coating, the thermal treatment directed to forming the structure necessary to render it drawable, given that this coating was carried out at a temperature lower than that of austenizing. In these conditions, the cooling of the wire after coating may be carried out very rapidly by passing it through a liquid, without modifying the crystalline structure of the steel obtained prior to coating. Given that the coating process takes place by moving the wire vertically from bottom to top, a rapid cooling of the wire allows the height of the installation to be reduced, especially with high speeds of wire advance.

However, from an economic point of view, important applications exist where it would be necessary to produce steel wires of small cross-section coated with metals whose melting point is appreciably greater than the austenizing temperature of steel. On one hand, the cross-section is too weak for the steel wire to be able to resist mechanically, while hot, the traction forces necessary to get it to travel through the bath of molten metal, while, on the other hand, with a cross-section sufficient to withstand the operating conditions, uncontrolled cooling of the coated wire would lead to a crystalline structure in the steel wire which would render it unsuitable for undergoing subsequent drawing, so that the wire could no longer be brought to the desired cross-section.

SUMMARY OF THE INVENTION

The aim of the present invention is precisely to remedy at least in part the above mentioned disadvantages.

Accordingly, the invention provides a method for the continuous coating of a filiform steel substrate by immersion of the substrate in a bath of molten coating metal, wherein a coating metal whose melting point is greater than the austenizing temperature of the steel is selected, the steel substrate is preheated to a temperature lower than that of said bath, it is passed into said bath to coat it and at the same time to bring its temperature to the austenizing temperature, the substrate thus coated is then cooled at a controlled rate suitable for conferring on the steel of said substrate a softened crystalline structure, and the substrate thus coated is drawn to bring it to the desired cross-section.

BRIEF DESCRIPTION OF THE DRAWINGS

The accompanying drawing illustrates, diagrammatically and by way of example, an embodiment of an installation for putting the method into practice.

DETAILED DESCRIPTION OF THE PRESENTLY PREFERRED EXEMPLARY EMBODIMENT

Figure 1:
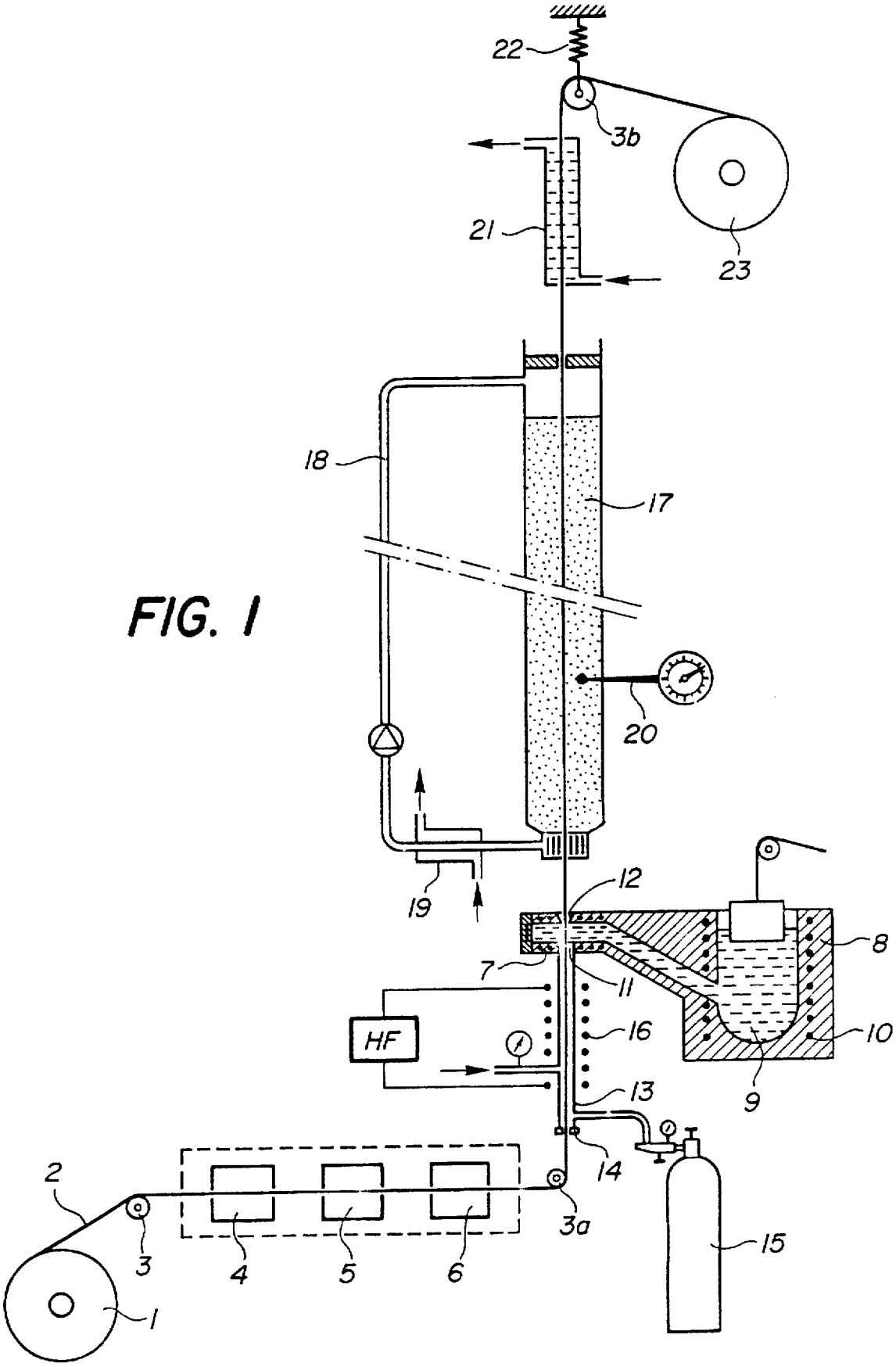
FIG. 1 is an elevation view of an installation for putting the method into practice.

The installation shown in FIG. 1 comprises a supply roll 1 of steel wire 2. This steel wire 2 passes over a first guide roller 3 to be directed through different treatment stations 4, 5, and 6, directed respectively to cleaning, rinsing and drying the wire 2. A pulling capstan 3*a* brings the steel wire 2 under a graphite spout 7 of a crucible 8 containing a bath 9 of molten metal heated by a heating body 10 housed in the wall of the crucible 8.

Before traversing the spout 7 of the crucible which, for this purpose, is provided with two vertically aligned openings 11 and 12, the steel wire 2 passes into a tubular duct 13 whose entrance is controlled by a seal 14. This tubular duct is connected to a source 15 of protective gas, for example, $H_2+N_2$, and is surrounded by a preheating electric coil 16 supplied by a high frequency source (HF). The maximum temperature of the wire is dependent on the preheating temperature and on the thickness of the layer deposited.

Depending on the type of steel used to form the filiform or wire substrate 2, cooling is carried out relatively rapidly for soft steels of less than 0.1% carbon. For steels of greater carbon content, unduly rapid cooling is not acceptable, given that these steels must be maintained at a temperature of the order of 550° C., corresponding to the maximum temperature of the TTT curve, for ten seconds or so, to obtain the required fine-grained ferrite-pearlite crystalline structure. Generally this temperature is obtained by making the copper-coated or brass-coated steel wire pass through a bath of molten lead. However, taking account of the fact that the coating process according to the invention occurs along a vertical path, this solution is difficult to put into practice. This is the reason why it is proposed to use a fluidized bed 17, which can be fed by an air circuit 18 associated with a heating device 19. A part of the heat necessary comes directly from the wire 2 itself. A thermal probe 20 allows regulation of the air temperature depending on the quantity of heat necessary to maintain the temperature of the fluidized bed at 540° C.

A second water-circulating cooling system 21 is disposed above the fluidised bed 17 to terminate the cooling of the wire 2 before this passes over a guide roller 3b, which is suspended by means of a resilient system 22 for regulating the tension of the wire 2. System 22 serves to control the pulling capstan 3a in such a way as to obtain a weak tension during coating. From this roller, the wire is taken to a storage drum 23. Given that a soft steel wire heated to 700° C.–800° C. becomes very fragile on contact with molten copper in particular, the pull exerted by the tension regulator 22 should not exceed 15 MPa.

Figure 2:
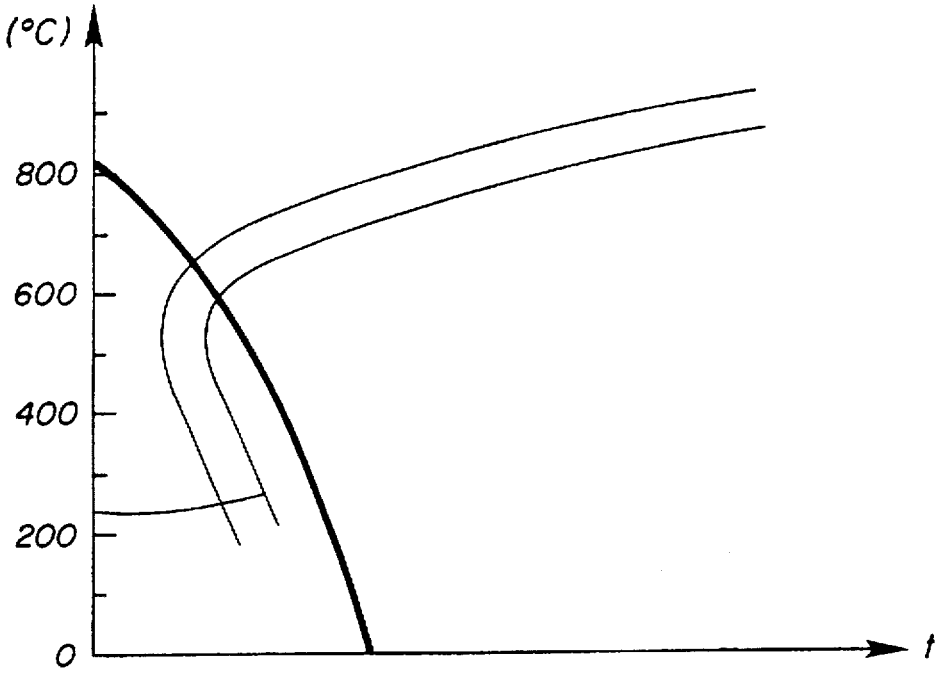
FIGS. 2 and 3 are TTT diagrams (time-temperature-transformation) for two types of steel.
Figure 3:
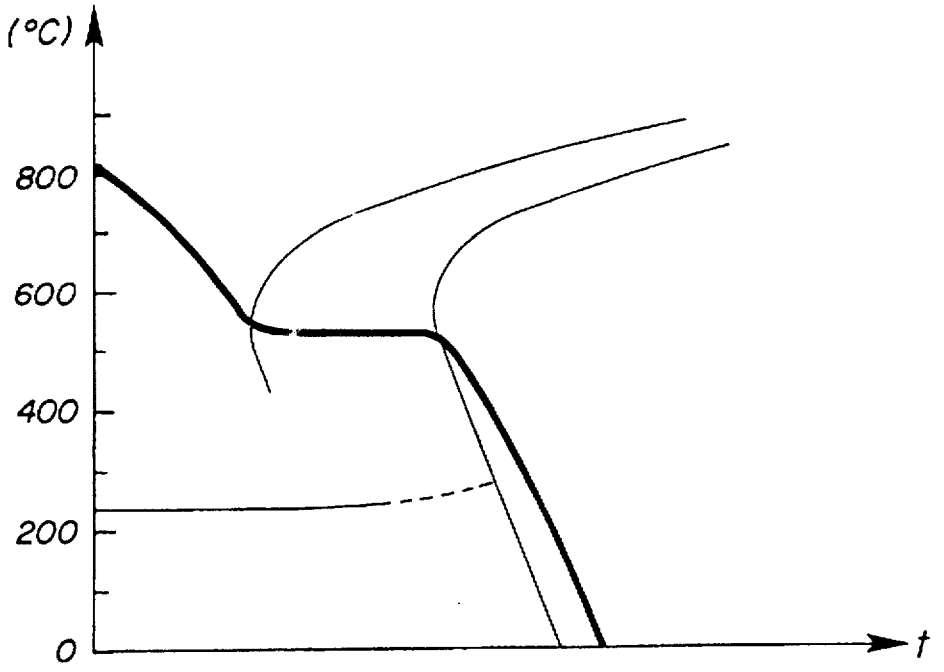

Different metals and alloys have been deposited on different types of steel wire. The common point between the examples which follow is the giving of a fine ferrite-pearlite crystalline structure to the steel as a result of controlled cooling. As will be seen in these examples, in the case of soft steels of less than 0.1% carbon, simple air cooling may be sufficiently slow to obtain the desired crystalline structure, so that in this case the fluidized bed 17 may be dispensed with, a sufficient distance being provided between the exit from the spout 7 and the cooling system 21 to allow the desired crystalline structure to be obtained. However, with steels of greater carbon content, having a greater hardenability, it is necessary to maintain the wire at a temperature of 540° C. for several seconds to avoid ambient-air tempering and to obtain a fine ferrite-pearlite crystalline structure. The diagrams in FIGS. 2 and 3 show diagrammatically and respectively the TTT curves (time-temperature-transformation) of a soft steel and of a steel of greater carbon content. On each of these diagrams, the controlled cooling curve of a steel wire coated with a metal whose melting point is greater than the austenizing temperature of the steel has been plotted.

In the examples which will follow, three metals and alloys are used, that is to say, copper, brass and silver. The soft steel wire coated with copper has applications in the electrical area, such as for telephone wire, for electrically conductive springs, and for the earth wire of an electric transmission line, for example. Brass-coated steel wire of 0.7% carbon has application, in particular, as reinforcing wire for radial tires. Finally, silver-coated soft steel wire has electronic applications. In each of these cases, the coated wire has a much greater cross-section than that of the finished wire, so that the thickness of the coating metal reduces at the same time as the diameter of the wire during re-drawing of the wire. This operation does not lead to a deterioration of the deposited metal layer if this adheres well to the wire.

EXAMPLE 1

This example concerns the deposition of a layer of copper on a soft steel wire.

Accordingly a steel wire of less than 0.1% carbon is used. The first operation consists of an alkaline electrochemical degreasing at 60° C., followed by attack in a bath of HCl and drying. Following this substrate preparation phase, the coating phase proper commences. This consists of preheating the wire 2 by means of the coil 16, which is fed with a high frequency current. At this moment, the wire 2 traverses the tubular duct 13 in which an atmosphere of 20% $H_2$+$N_2$ at a pressure of 5 mm water column prevails. The temperature of the steel wire 2 is thus brought to 740° C. the moment it enters the spout 7 of the crucible 8 through aperture 11. The spout of the crucible contains 70 g of liquid Cu at a temperature of 1120° C. corresponding to a liquid bath of 5 mm thickness.

The wire is subsequently cooled in air for 10 seconds before entering the water cooling enclosure 21. The rate of travel of the wire 2 is about 30 m/min. The layer of copper obtained is a layer of 200 μm, which is concentric with and adherent around the steel wire 2. The wire may then be re-drawn with a reduction of 80% in its cross-section.

EXAMPLE 2

The steel wire used in this example is a steel wire of 0.7% carbon and of 1 mm diameter. The preparation of the wire is identical to that of the wire in Example 1, as is its preheating.

The spout 7 of the crucible 8 contains a layer of 40 mm of brass comprising 60% Cu and 40% Zn at a temperature of 1000° C.

At the outlet from spout 7, the brass-covered wire enters the fluidized bed 17, whose temperature is maintained at 540° C. The rate of advance of the wire is about 30 m/min., and the fluidized bed has a path length of 5 m, so that the wire is maintained at this temperature of the order of 550° C. for 10 seconds, the time required to bring the steel into the fine-grain ferrite-cementite region. The layer obtained has a thickness of 15 μm formed concentrically around the steel wire and adherent to its surface.

EXAMPLE 3

A wire of soft steel of less than 0.1% carbon, of 1 mm diameter, is covered with a layer of Ag.

The cleaning and preheating of this wire is carried out under the same operational conditions as those of the preceding examples.

The spout 7 of the crucible contains 70 g of liquid Ag at 990° C. in an atmosphere of 10% $H_2$+$N_2$.

The cooling is carried out in air as in Example 1, and a concentric and adherent layer of silver 50 μm thick is obtained.

Each of the wires obtained according to the preceding examples has a diameter several times greater than the desired diameter. This is why, for example, the wire in Example 2 is then re-drawn to bring it to a final diameter of 0.25 mm.

It must also be noted that on an economic scale, the fact of carrying out the annealing of the steel at the same time as its coating allows an operation to be eliminated, and thus, a not-insignificant reduction in production costs.

I claim:

1. A method for continuously coating a hard-drawn filiform steel substrate by immersion of the substrate in a bath of molten coating metal, said method consisting of the steps of:

selecting a coating metal made from at least one element selected from the group consisting of Cu, Ag and brass with any combination thereof having a melting point greater than an austenizing temperature of the steel substrate;

preheating the steel substrate to a temperature lower than that of said bath;

passing the steel substrate with the temperature being maintained, under tension through a bath of molten coating metal to both coat the substrate with an adherent, concentric layer of the coating metal and heat the substrate to at least its austenizing temperature, the substrate being immersed in the bath for about 0.01 seconds and with the tension exerted on the steel substrate being 15 MPa or less;

maintaining the coated substrate at an elevated temperature for a time sufficient to produce a fine-grained ferrite-pearlite crystalline structure in the steel substrate;

cooling the coated steel substrate;

without further heat treatment, redrawing the coated substrate, said redrawing producing a reduction in area of from about 0–95%.

2. A method according to claim 1, wherein a soft steel filiform substrate of less than 0.1% carbon is coated and this substrate is then cooled at a rate selected to obtain a ferrite-pearlite structure.

3. A method according to claim 1, wherein a steel filiform substrate containing more than 0.2% carbon is coated and the temperature of this coated substrate is rapidly lowered to a temperature of the order of 550° C., the substrate is subsequently maintained at this temperature until transformation into a fine-grained ferrite-pearlite structure, and the cooling of the substrate is then terminated.

* * * * *